US006398215B1

(12) United States Patent
Carroll

(10) Patent No.: US 6,398,215 B1
(45) Date of Patent: Jun. 4, 2002

(54) SHOOTING TARGET SYSTEM, COMPONENTS THEREFOR AND METHODS OF MAKING THE SAME

(76) Inventor: Chris Carroll, 4648 S. Wildwood Dr., Springfield, MO (US) 65810-1235

( * ) Notice: Subject to any disclaimer, the term of this patent is extended or adjusted under 35 U.S.C. 154(b) by 62 days.

(21) Appl. No.: 09/585,671

(22) Filed: Jun. 1, 2000

Related U.S. Application Data

(60) Provisional application No. 60/170,605, filed on Dec. 14, 1999.

(51) Int. Cl.[7] ..... A63B 67/14

(52) U.S. Cl. ..... 273/108; 473/439; 473/422; 473/454; 273/390; 273/391; 273/402; 273/407; 482/82; 482/83

(58) Field of Search ..... 273/370–395, 273/402, 407, 410, 363, 383, 387, 381; 473/422, 439, 454; D21/302, 699; 482/82, 83

(56) References Cited

U.S. PATENT DOCUMENTS 2,008,359 A * 7/1935 Lamb ..... 273/402
2,133,552 A 10/1938 Long
2,443,131 A * 6/1948 Fessler ..... 473/453
3,580,178 A * 5/1971 Kopsch ..... 102/92.2
3,720,413 A * 3/1973 Ready ..... 473/191
4,588,194 A * 5/1986 Steidle et al. ..... 273/391
4,614,345 A 9/1986 Doughty
4,691,925 A 9/1987 Scholem
4,936,578 A * 6/1990 Hudson, Sr. ..... 473/439
5,163,689 A 11/1992 Gateman
5,263,721 A * 11/1993 Lowrance ..... 273/390
5,280,919 A * 1/1994 Graham ..... 273/407
5,352,170 A * 10/1994 Condo et al. ..... 482/83

* cited by examiner

*Primary Examiner*—Paul T. Sewell
*Assistant Examiner*—Mitra Aryanpour
(74) *Attorney, Agent, or Firm*—Richard L. Marsh

(57) ABSTRACT

A shooting target system comprising a substantially vertical post having a target assembly comprising a double faced target, a stub shaft and a pivot shaft, the target assembly rotatably mounted upon the post wherein the post further releasably captures the target assembly at each one of a plurality of positions spaced vertically upon the post.

3 Claims, 3 Drawing Sheets

SHOOTING TARGET SYSTEM, COMPONENTS THEREFOR AND METHODS OF MAKING THE SAME

CROSS REFERENCE TO RELATED APPLICATION

This application is a non-provisional application under 35 U.S.C. 111 (a) of its parent provisional application Serial Number 60/170,605 filed Dec. 14, 1999.

BACKGROUND OF THE INVENTION

1. Field of the Invention

This invention relates to a shooting target system for high power firearms comprising a substantially vertical post having a target assembly rotatably mounted thereupon wherein the post further has means to releasably capture the target at each of a plurality of positions spaced vertically upon said post.

2. Prior Art Statement

It is known to provide a dueling tree wherein the dueling tree has multiple targets disposed upon a vertical post, each target adapted to easily pivot from one side to another side in substantially the same vertical position upon the post. A dueling tree is not usable for high powered firearms. For instance, see the Internet home page of Metal Spinning Targets, Inc., found at www.metaltargets.com.

It is also known to provide a light table game having a two faced target that can spin about a horizontal axis registering a new position with each rotation. Its primary object is a dueling target wherein one shooter may add to his own score or subtract from the score of another A horizontal graduated scale registers the position of each shot. For instance, see the U.S. Pat. No. 2,133,552 issued on Oct. 18, 1938 to Sidney L. Long.

It is further known to provide a target made from armor-like metal the target affixed to a crook shaped arm pivotally mounted on two uprights welded to a steel channel A counterweight at the opposite end of the crook shaped arm returns the target to the upright position. For instance, see U.S. Pat. No. 4,614,345 issued on Sep. 30, 1986 to Steven P. Doughty Additionally, it is known to provide a target, intended for law enforcement agencies, comprises a base having spaced apart supports with a mounting plate welded between the supports. A detachable upright angle iron post fits between two short sections of angle iron welded to the mounting plate. A detachable target of ⅜" steel is fitted to the top of the post by sliding an angle bracket welded to the target plate between a pair of short sections welded to a cross bar affixed to the top of the post. The parts are separable, making the device portable. For instance, see the U.S. Pat. No. 4,691,925 to Paul Scholem issued on Sep. 8, 1987.

Finally, it is known to provide a target pivotally mounted on an upright post comprising an open channel with an optional V-shaped front piece. The target pivots about a vertical axis and may be set to a partial view by an internal power assisted mechanism. For instance, see the U.S. Pat. No. 5,163,689 issued on Nov. 17, 1992 to Kyle E. Bateman.

SUMMARY OF THE INVENTION

Metal shooting targets have been available on the market for many years. Some of those currently available on the market have multiple moving parts subject to wear especially in an outdoor environment. Others are designed for low power firearms such as rim-fire rifles and hence are destroyed by high power firearms. Still others may have a fixed target. There is a need for a high power firearm target to be used primarily by law enforcement personnel which can provide the shooter with multiple positions of a target to improve the aiming skills of the shooter.

Therefore, it is an object of this invention to provide a target system which comprises a substantially vertical post having a target assembly rotatably mounted thereupon wherein the post further has a means to releasably capture the target at each one of a plurality of positions spaced vertically upon said post.

It is also an object of this invention to provide a shooting target system comprising a substantially vertical post having at least one double faced target rotatably mounted thereupon, said post further having means for capturing the target at one of a plurality of positions spaced vertically upon said post.

It is a further object of this invention to provide a shooting target system having a target assembly comprising a double faced target, a stub shaft and a pivot shaft wherein the stub shaft is disposed substantially perpendicular to the central axis of the pivot shaft.

It is still another object of this invention to provide a target assembly for a shooting target system, the target assembly comprising a double faced target, a stub shaft and a pivot shaft, the double faced target disposed substantially perpendicular to the central axis of the stub shaft and substantially parallel to the central axis of the pivot shaft.

Yet another object of this invention is to provide a circular double faced target for a shooting target system wherein the center point of the double faced target is aligned with the central axis of the stub shaft.

Still another object of this invention is to provide a shooting target system having a target assembly which pivots from one side of a vertical post to the other side of a vertical post when a target is struck with a slug discharged from a firearm, the target assembly exposing a first face of the target in a shooting position when the target is disposed on the one side of the vertical post and exposes a reverse face in a shooting position when the target is disposed on the other side of the vertical post.

It is yet another object of this invention to provide a target for a shooting target assembly which is formed from hardened steel plate having a Brinell hardness of 400 or better.

Finally, it is an object of this invention to provide a shooting target system having only one movable part wherein the movable part traverses vertically downward by force of gravity each time the target is moved from one side of a vertical post to another side of the vertical post.

DESCRIPTION OF THE PREFERRED EMBODIMENTS

While the various features of this invention are hereinafter described and illustrated as a shooting target system comprising a substantially vertical post having at least one double faced target rotatably mounted thereupon and wherein the post further has means for capturing the target at one of a plurality of positions spaced vertically upon the post, it is to be understood that the various features of this invention can be used singly or in various combinations thereof to provide a shooting target system for high powered firearms as can hereinafter be appreciated from a reading of the following description.

Figure 1:
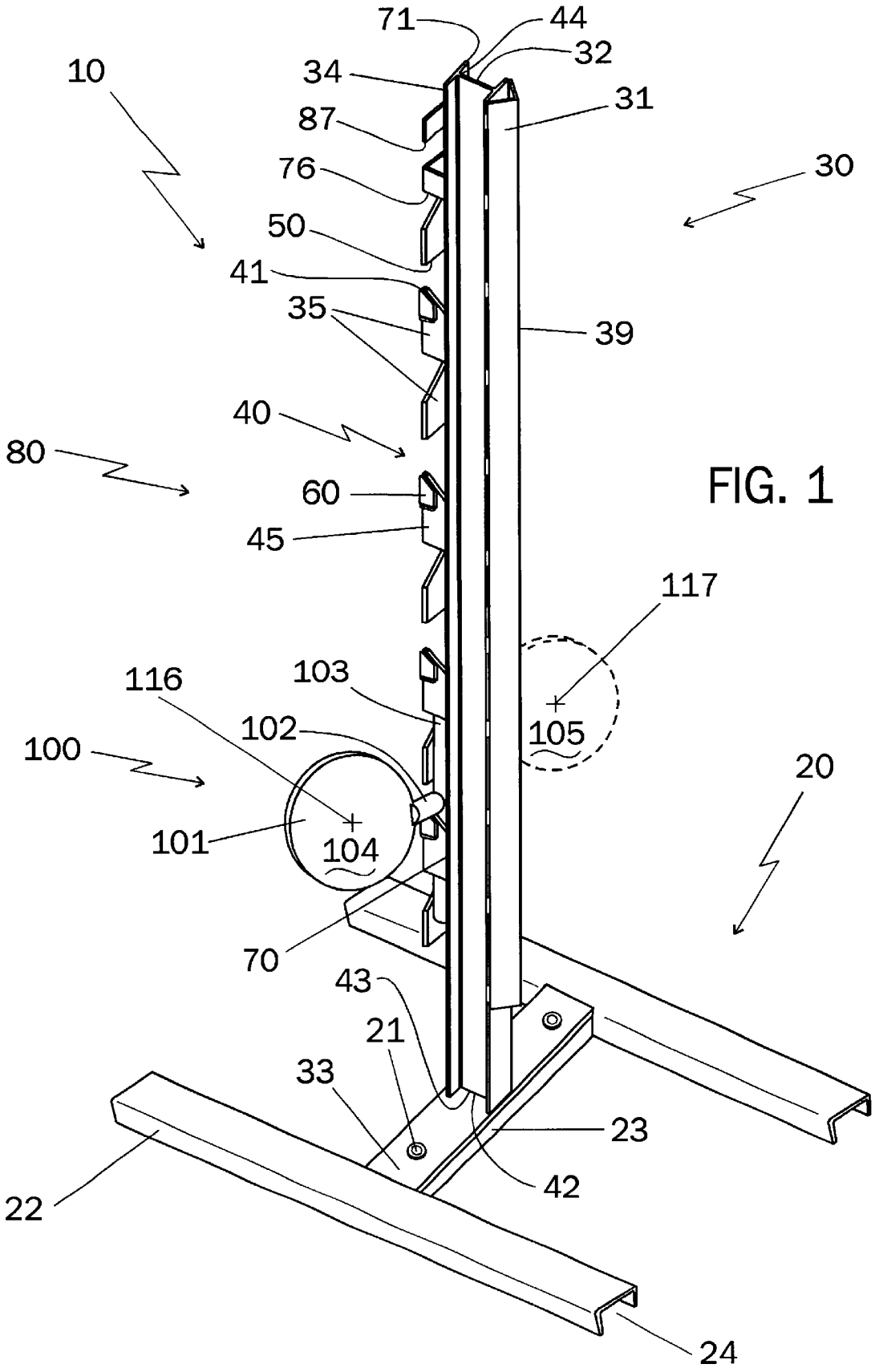
FIG. 1 is a left upper frontal perspective view of the preferred embodiment of the shooting target system of this invention.
Figure 2:
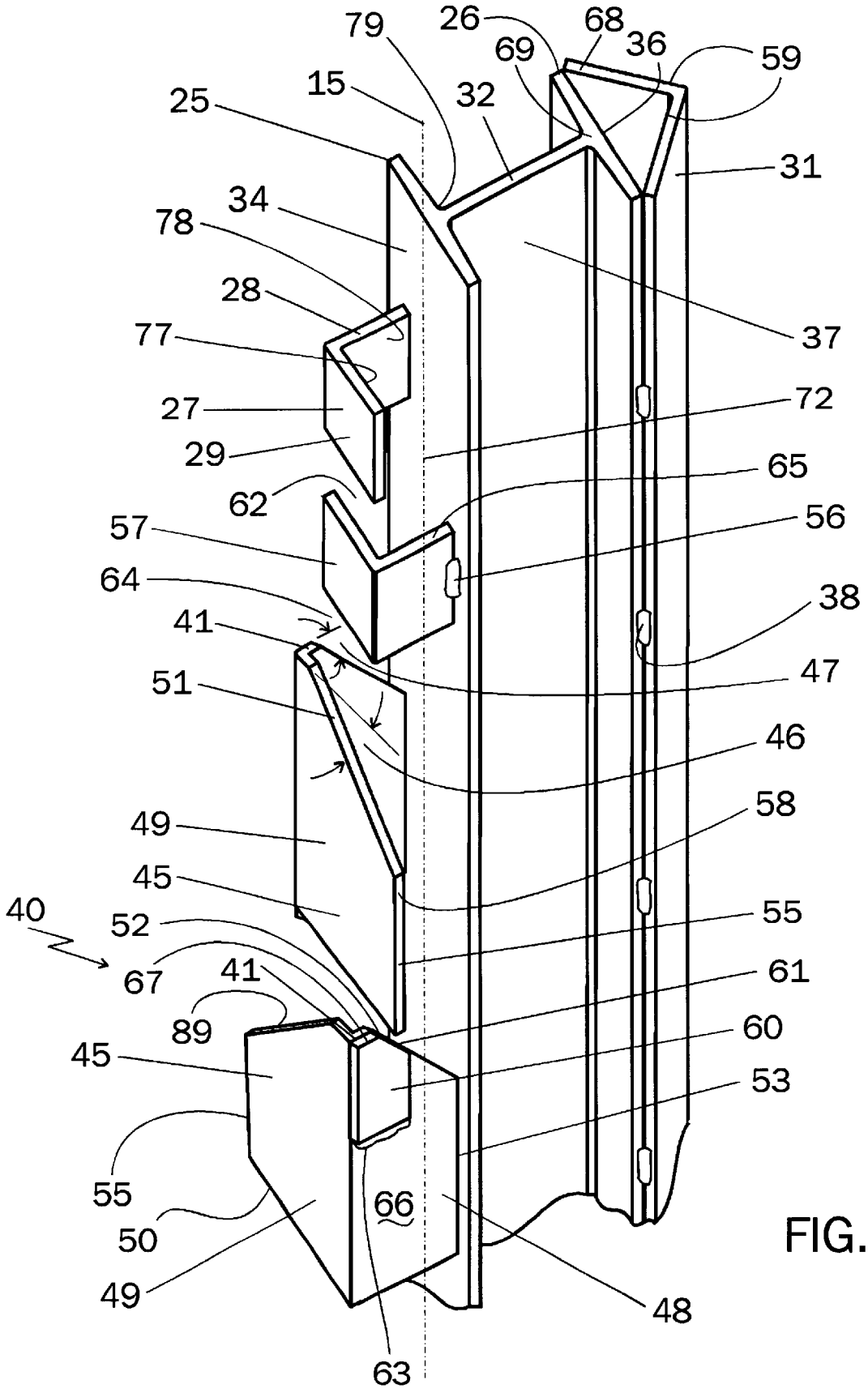
FIG. 2 is a right upper rear perspective view of the preferred embodiment of FIG. 1 showing upper two capture brackets and two stabilizing brackets.

Referring now to FIGS. 1 and 2, a shooting target system generally referred to by the numeral 10 is shown, shooting target system 10 comprising a substantially vertical post 30 having a target assembly 100 rotatably mounted thereupon. Post 30 further has a means for releasably capturing target 100 at each one of a plurality of target shooting positions 35 spaced vertically upon a first face 34 of post 10. Means for capturing is generally referred to by the numeral 40 and comprises a capture bracket 45 having a capture surface 52 disposed at a capture angle 47, capture bracket 45 extending from first face 34 of an I-beam 32, I-beam 32 having a web 37 spacing apart the two flanges 25 and 26. Post 10 also has a base plate 33 affixed to the bottom end 43 thereof and has an anti-spray shield 31 extending from second flange 26. Post 10 stands vertically upon a base 20, base 20 comprising two feet 22 spaced apart by an intermediate cross piece 23. Cross piece 23 and feet 22 are channel beams having the channel 24 facing downwardly thereby providing stability upon any substantially horizontal surface. Furthermore, as channel 24 faces downwardly, channel 24 does not collect debris or hold moisture therein. Anti-spray shield 31 has its legs 59 spanning across flange 26 and is affixed to the edges of flange 26 by welding legs 59 to flange 26, anti-spray shield 31 extending along second flange 26 from a position near bottom end 43 to at least top end 44. Anti-spray shield 31 thus deflects slugs from a firearm fired at target 100 away from a return path to the shooter.

Target assembly 100 comprises a double faced target 101, a stub shaft 102 and a pivot shaft 103, stub shaft 102 disposed substantially perpendicular to the central axis 115 of pivot shaft 103. Double faced target 101 is disposed substantially perpendicular to the central axis 114 of stub shaft 102 and substantially parallel to central axis 115 of pivot shaft 103. Preferably, double faced target 101 is circular having the center point 116 of double faced target 101 aligned with central axis 114 of stub shaft 102. Double faced target 101 is preferably disposed in a slot 107 in stub shaft 102. Though only one double faced target assembly 100 is generally mounted upon vertical post 30, it is possible to have more than one target assembly 100 thereon. Therefore, this invention contemplates a shooting target system 10 comprising a substantially vertical post 30 having at least one double faced target assembly 100 rotatably mounted thereupon wherein vertical post 30 further has means to capture 40 target assembly 100 at one of a plurality of positions spaced vertically upon post 30.

Post 30 may have any number of means for capturing 40 spaced along face 34 of I-beam 32 however, in the preferred embodiment shown in FIGS. 1 and 2, nine means for capturing 40 are provided with each successive means for capturing 40 having a straight edge 55 facing opposite the previous straight edge 55. Capture surface 52 and riding surface 41 of each capture bracket 45 may be hardened by means known in the art of metal working, however, it has been found by the teachings of this invention to provide a separate hardened steel pad 60 alongside the outer surface 66 of outright leg 48 of each capture bracket 45, steel pad 60 having a dent and wear resistant surface 61 provided on one edge, dent and wear resistant surface 61 disposed at an angle equal to capture ramp angle 47. Likewise, hardened steel pad 60 has a dent and wear resistant surface 67 along the top thereof, dent resistant surface 67 being parallel to riding surface 41. Hardened steel pads 60 are affixed to outer surface 66 by welding same onto surface 66 as shown at weld 63 having dent and wear resistant surface 61 aligned with capture ramp angle 47 and dent resistant surface 67 aligned with riding surface 41. Target assembly 100 rests on surface 52 and dent and wear resistant surface 61 at each means to capture 40 and when a slug strikes target 101, target assembly 100 moves upwardly along dent and wear resistant surface 61 along and across surface 41 and dent and wear resistant surface 67. As is readily apparent, target assembly 100 is adapted to rotate from one side edge 71 to other side edge 70 of post 30 as target 101 of target assembly 100 is struck with a slug from a firearm. Though dent and wear resistant pads 60 are preferably affixed to outside surface 66 of each capture bracket 45, these pads could as well be affixed to inside surface 46 of capture bracket 45.

Still referring to FIGS. 1 and 2, when a shooter wants to use shooting target system 10 for shooting practice, target system 10 has feet 22 of base 20 placed upon a flat support surface such as an open field with a backdrop behind target system 10. Either end of the pivot shaft 103 of target assembly 100 is placed alongside the opening 72 between first stabilizing bracket 27 and second stabilizing bracket 57 having stub shaft 102 resting upon the top surface 65 of a base leg 28 of second stabilizing bracket 57. Target assembly 100 is then rotated counterclockwise through slot 62 between first stabilizing bracket 27 and second stabilizing bracket 57 about axis 115 of pivot shaft 103, axis 115 substantially coincident with axis 15 of post 30. Target assembly 100 is then lowered upon capture surface 52 of means for capturing 40 of a first capture bracket 45. The shooter then paces away from shooting target system 10, faces target system 10, aims at the center point 117 of first face 105 of target 101 of target assembly 100 and shoots. If the slug from the firearm hits center point 117 or outside thereof away from post 30, target assembly 100 rotates fully about axis 115 until stub shaft 102 impacts face 34 of flange 25 on other side 70 of post 30, target assembly 100 then dropping along drop slide surface 51. Target assembly 100 then drops along face 34 behind parallel leg 49 of capture bracket 45 until stub shaft 102 comes to rest upon capture surface 52 of second capture bracket 45. The shooter then aims and shoots again now at center point 116 on reverse face 104 of target 101 repeating the rotating and dropping sequence. However, if the slug from the firearm hits inboard of center point 116, target assembly 100 may not rotate fully but remains resting upon riding surface 41. Thus, the partially rotated target assembly 100 presents a reduced area of target 101 requiring the shooter to fire a second shot at the reduced area of target 101 to filly rotate target assembly 100 through the dropping sequence to the next means for capturing 40. As can be readily observed in FIG. 1, a shooter shoots at one face 105 of target 101, shown in dashed lines, and when target 101 is properly struck with a slug from the firearm used by the shooter, the force of the slug pivots target assembly 100 from one side 71 of post 30 to other side 70 presenting reverse face 104 for the next shot. Thus, target assembly 101 exposes a first face 105 of target 101 when target 101 is disposed on one side 71 of vertical post 30 and exposes reverse face 104 when target 101 is disposed on other side 72 of vertical post these faces 104, 105 being alternately exposed until stub shaft 102 of target assembly 100 falls along face 34 behind parallel leg 49 of last capture bracket 45 and pivot shaft 103 disengages from behind last capture bracket 45. Target assembly 100 then drops free of post 30 and can be picked up and reinserted in opening 72 of first stabilizing bracket 27 to begin another practice round. As target assembly 100 is of unitary construction wherein target 101 is affixed to stub shaft 102 which is in turn affixed to pivot shaft 103 and as vertical post 30 remains stationary upon mounting surface, shooting target system 10 comprises only the one movable part, namely target assembly 100. As there is only the one moving part and wherein that moving part moves generally upon hardened steel surfaces 61, 67, wear and tear upon shooting target system 10 is greatly reduced thereby having this great advantage over prior art shooting targets. Furthermore, as the one movable part traverses vertically downward by force of gravity each time target 101 is moved from one side 70 of vertical post 30 to the other side 71 of vertical post 30 thereby presenting an alternating shooting surface 104, 105 to the shooter at each of plurality of shooting positions 40 there are no springs or levers necessary to reposition target assembly 100.

Base 20 is preferably constructed of standard three inch steel channel wherein each leg 22 of base 20 is cut to approximately two feet in length and cross piece 23 is cut to approximately one and one half feet in length. Cross piece 23 is butt welded to each leg 22 of base 20 at approximately the mid point of each leg 22 having the upper surface of each leg 22 and cross piece 23 aligned in the same plane. Thus, the bottoms of the legs of each of the pieces of channel iron comprising legs 22 and cross piece 23 are also aligned in the same plane spaced from the plane of the upper surface. Base plate 33 for post 30 is cut to approximately the same length as cross piece 23, cross piece 23 and base plate 33 having matching bolt holes provided therethrough. Cross piece 23 is securely welded to each leg 22 substantially around each of the downwardly projecting legs and the web therebetween on substantially the entirety of the interior and exterior surfaces thereof Post 30 is preferably constructed of a standard three-inch steel I-beam approximately five feet in length from bottom end 43 to top end 44 Bottom end 43 is welded to the center of base plate 33 such that web 37 of post 30 is transverse the longitudinal direction of base plate 33 and perpendicular thereto with flanges 25 and 26 parallel to and substantially aligned with the edges of base plate 33. A base weld 42 securely mates post 30 to base plate 33, base weld 42 joining substantially all contiguous surfaces of flanges 25, 26 and web 37 to base plate 33. Bolt holes are provided in base plate 33 aligned with bolt holes provided in cross piece 23 of base 20. Post 30 is securely bolted to base 20 utilizing one-half inch threaded machine bolts 21 passed through the mating bolt holes in base plate 33 and cross piece 23, however, if permanent mounting of target system 10 is desired, base plate 33 may be welded to cross piece 23. In the preferred embodiment, base 20 is separable from base plate 33 such that target system 10 may be transported for use by multiple users in various locations.

Anti-spray shield 31 is preferably made integral with post 30 by inverting legs 59 of a two by two inch steel angle and placing same against face 36 of flange 26 with the apex 39 of the angle iron facing away from face 36. Anti-spray shield 31 may be approximately the same length as post 30 having top end 68 aligned with upper end 69 of flange 26 while the end opposite top end 68 in the preferred embodiment is spaced above base plate 33. The ends of legs 59 of anti-spray shield 31 are securely welded to the edges of flange 26 as shown at weld 38 at numerous places along the length thereof Anti-spray shield 31 protects the shooter from a ricochet of any slug striking post 30 instead of striking target 101. There is no need for anti-spray shield 31 to extend fully to base plate 33 as slugs striking post 30 substantially at base plate 33 will be deflected into the surface upon which target assembly 10 is resting. Top 68 of legs 59 is generally left uncovered though top 68 of legs 59 and top 69 of flange 26 may be covered with a solid element to prevent entrance of any foreign material to the space therebetween.

Opposite anti-spray shield 31, a means for rotatably retaining target assembly 100 to post 30 is provided. Means for rotatably retaining is generally denoted by the numeral 80 and comprises at least one stabilizing bracket 27 or 57 and multiple means for capturing 40 evenly spaced apart. In the preferred embodiment, a first stabilizing bracket 27 is affixed to face 34 of flange 25 of post 30 spaced from top surface 79 of flange 25 though bracket 27 may be affixed substantially at top surface 79 of flange 25. First stabilizing bracket 27 comprises a section of 1½ by 1½ inch steel angle approximately 1½ inches in length. Base leg 28 of first stabilizing bracket is machined to a length of 1.400 inches such that when bracket 27 is affixed to face 34, the distance from face 34 to an inside face 77 of outer leg 29 of bracket 27 readily accepts pivot shaft 103 therebetween. The distance between face 34 and face 77 is between 1.160 and 1.200 inches to accommodate an inch and one-eighth diameter pivot shaft 103 therein allowing pivot shaft 103 to freely rotate without binding and particularly without chatter when rotating about axis 15. The inside face 78 of base leg 28 of first stabilizing bracket 27 is spaced approximately one half the diameter of pivot shaft 103 from vertical axis 15 and thus is approximately nine sixteenths of an inch from axis 15. A second stabilizing bracket 57 is also affixed to face 34 spaced by slot 62 from first stabilizing bracket 27, second bracket 57 having a top surface 65 approximately one and one-half inches below bottom surface 87 of bracket 27 such that stub shaft 102 may pass therebetween. Preferably, first and second bracket 57 are welded to face 34 at several points along the juncture therebetween as shown at weld 56 on bracket 57. Thus, slot 62 between top surface 65 and bottom surface 87 is from about 1.300 to 1.500 inches and most preferably is 1.40 inches. Second bracket 57 is identical to first bracket 27 though second bracket 57 is spaced approximately nine sixteenths of an inch from and on the opposite side of axis 15 and faces a direction opposite bracket 27 Top surface 65 is machined square with and perpendicular to face 34. First and second brackets 27, 57 allow for initial placement of target assembly 100 at a top most means for capturing 40 while releasably holding target assembly 100 in a fully upright position.

At least one, and preferably several, means for capturing 40 are equally spaced below second stabilizing bracket 57, each means for capturing 40 comprising a capture bracket 45 affixed to face 34 and extending therefrom. Preferably, capture bracket 45 is affixed to face 34 by welding along an edge 53 thereof. Each capture bracket 45 comprises a section of 1½ by 1½ inch steel angle approximately 4 inches in length having a top riding surface 41, a drop slide angle 46 forming drop slide surface 51, a bottom surface 50, a straight edge 55 and a capture ramp angle 47. As with stabilizing brackets 27, 57 each capture bracket 45 has its outright leg 48 machined to a precise height such that the inside surface 89 of parallel leg 49 is from about 1.160 to 1.200 inches from surface 34. Capture ramp angle 47 is disposed on an outright leg 48, outright leg 48 disposed perpendicular to and affixed to face 34. The first and subsequent odd numbered capture brackets 45 have outright leg 48 vertically aligned with base leg 28 of first stabilizing bracket 27 while the even numbered capture brackets 45 have outright leg 48 vertically aligned with base leg 28 of second stabilizing bracket 57. Capture angle 47 slopes toward face 34 from riding surface 41 at an angle between twenty and sixty degrees from the horizontal and most preferably at forty degrees. Stub shaft 102 of target assembly 100 is adapted to come to rest slightly below riding surface 41 on a capture surface 52 of capture angle 47 and against face 34 to releasably hold target assembly 100 in a firm position for each shot. If angle 47 is too steep, target assembly 100 will be unable to be released therefrom and target assembly 100 becomes a fixed target. If angle 47 is too shallow, target assembly 100 releases to easily from angle 47 thereby signaling to the shooter that every shot was accurately placed or the target may advance beyond the next immediate means for capturing 40. When angle 47 is approximately forty degrees, high velocity bullets utilized in military pistols and police pistols must hit the presented face 104, 105 of double faced target 101 at or outside center point 116, 117 in order to cause target assembly 100 to ride upwardly along angle 47 and across riding surface 41 enabling target assembly 100 to drop along drop surface 51 to the next means for capturing 40 immediately below the target position previously occupied by target assembly 100. As hereinbefore stated, if a slug hits inboard of center point 116, 117, target assembly 100 generally does not fully ride up capture surface 52 and fully across flat riding surface 41 thereby turning target 101 only partially about axis 115. A second shot at a reduced presentation area of target 101 is then required to fully turn target 101 such that target assembly 100 drops along drop slide angle 46 and drop slide surface 51. previously occupied by target assembly 100. As hereinbefore stated, if a slug hits inboard of center point 116, 117, target assembly 100 generally does not fully ride up capture surface 52 and fully across flat riding surface 41 thereby turning target 101 only partially about axis 115. A second shot at a reduced presentation area of target 101 is then required to fully turn target 101 such that target assembly 100 drops along drop slide angle 46 and drop slide surface 51.

The uppermost capture bracket 45 has a space 64 between flat riding surface 41 and the underside surface 76 of second stabilizing bracket 57. Space 64 is smaller than slot 62 between first stabilizing bracket 27 and second stabilizing bracket 57. Therefore, space 64 is from about 1.220 to 1.350 inches and most preferably is 1.250 inches. Similarly, each successive capture bracket 45 is spaced from the capture bracket 45 immediately above it by this same distance, space 64 being measured from flat riding surface 41 of a given capture bracket 45 to the bottom 50 of the capture bracket 45 immediately above the given capture bracket 45. Space 64 allows target assembly 100 to pass therethrough while pivoting about axis 115.

Capture bracket 45 has drop slide surface 51 disposed at an angle between thirty and seventy five degrees to a horizontal plane parallel to riding surface 41. Most preferably, drop slide surface 51 is sixty degrees and extends from riding surface 41 to a point 58 where straight edge 55 begins. Drop slide surface 51 allows target assembly 100 to slide downwardly therealong if a slug striking target 101 has just sufficient force to rotate target assembly 100 upwardly along capture surface 52 and across riding surface 41 but insufficient force to cause target assembly to fully rotate from one side 71 to other side 70 wherein stub shaft 102 fully engages face 34. In this case, stub shaft 102 of target assembly 100 slides downwardly along drop slide surface 51 until reaching point 58 wherein target assembly 100 completes rotation about axis 115, drops downwardly between parallel leg 49 and first face 34, assuming a new target position at a new capture surface 52 of the next lower means for capturing 40. To an expert marksman, drop slide angle 46 and drop slide surface 51 are generally substantially unused as a properly placed slug on target 101 causes target assembly 100 to rotate fully thereby impacting face 34 upon completion of rotation and wherein stub shaft 102 immediately falls behind inside surface 89 as the weight of target assembly 100 causes target assembly 100 to fall by force of gravity immediately upon clearing riding surface 41.

Capture bracket 45 is formed from steel angle iron and welded to face 34 as hereinbefore recited, however, the impact force upon capture surface 52 created by the dropping of target assembly 100 would cause damage to capture surface 52 and riding surface 41 rendering target system 10 increasingly useless as dents would form upon capture surface 52 resulting in a greater force by a fired slug in order to rotate target assembly 100. Therefore, capture surface 52 and riding surface 41 are both reinforced with a dent and wear resistant pad 60 machined to be parallel to and welded alongside these surfaces. Dent and wear resistant pad 60 is cut from a wear plate steel having dent and wear resistant surface 61 cut equal to capture ramp angle 47 along one edge and dent and wear resistant riding surface 67 cut to coincide with riding surface 41. At least one dent and wear resistant pad 60 is then clamped to each capture bracket aligning the angled surfaces 47, 61 and riding surfaces 67, 41 before welding dent and wear resistant pad 60 to capture bracket 45. Dent and wear resistant pad 60 may be formed from boiler plate, T-1 armor plate or plow share steel, however, it has been found by the teachings of this invention that the preferred material is one-quarter inch thick wear plate steel having a Brinell hardness number of at least 400. Although, dent and wear resistant pad 60 may be spot welded along outside surface 66 of capture bracket 45, dent and wear resistant pad 60 is typically welded fully along all mating surfaces with capture ramp angle 47 and riding surface 41 ground smooth after welding. Capture brackets and stabilizing brackets are typically made from ¼ inch thick angle iron.

Figure 3:
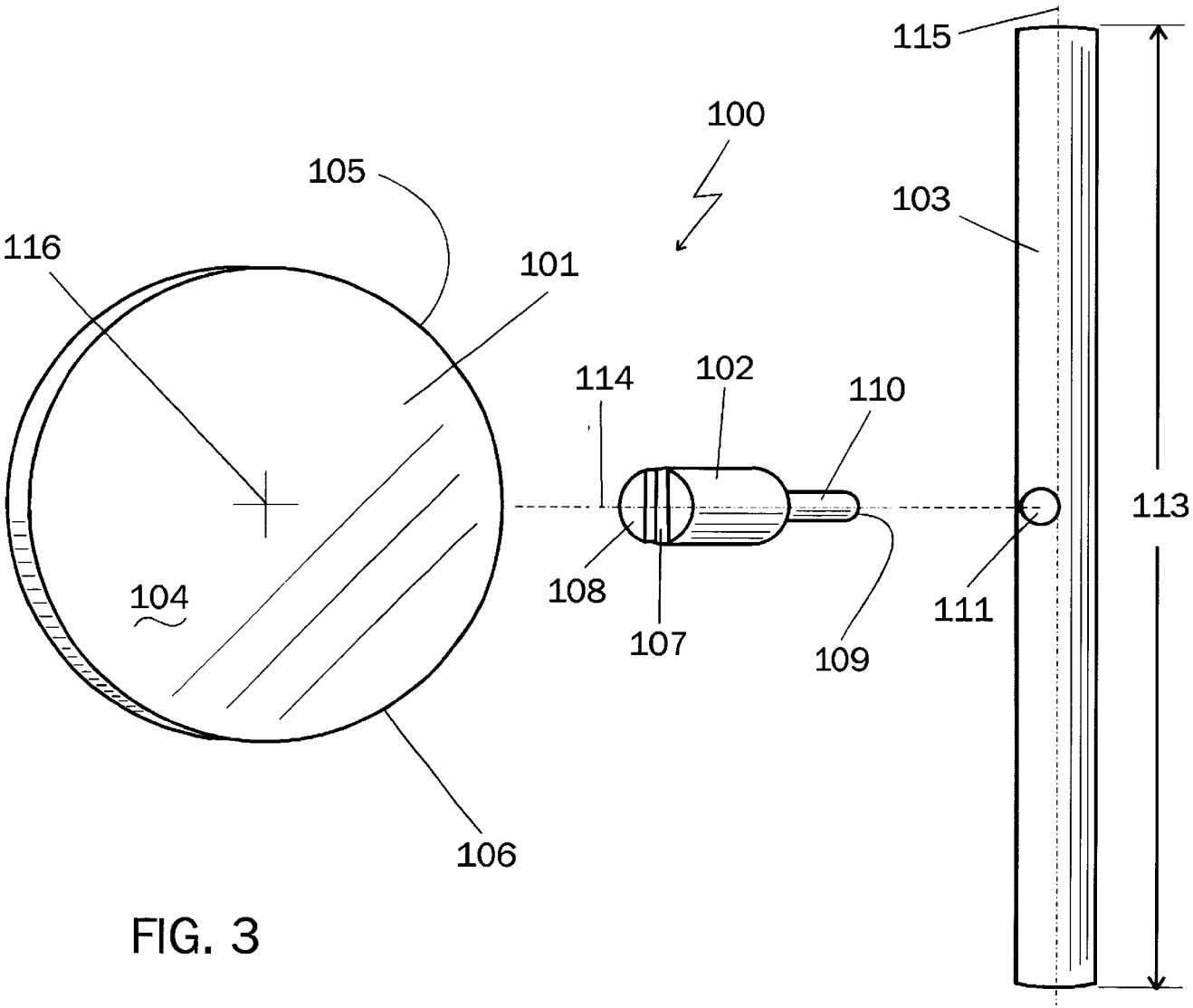
FIG. 3 is an enlarged exploded perspective view of the target assembly of the preferred embodiment of FIG. 1.

Referring now to FIG. 3, a shooting target system 10 comprises a substantially vertical post 30, a substantially horizontal base 20 and a rotatable, translatable double side target assembly 100 wherein substantially vertical post 30 comprises an I-beam 32, a bottom member 33 and an anti-spray shield 31. I-beam 32 has a plurality of capture brackets 45 affixed to one face 34 thereof and anti-spray shield 31 affixed to face 36 opposite one face 34. Bottom member 33 is affixed to one end 43 of I-beam 32, bottom member 33 having attaching holes disposed therethrough. Horizontal base 20 comprises at least two leg portions 24 separated by a central cross piece 23 wherein central cross piece 23 has attaching holes disposed therethrough to align with the attaching holes in bottom member 23. Cross piece 23 is affixed to leg portions 24 substantially in the center of each leg portion 24. Target assembly 100 comprises a double faced circular target 101, a stub shaft 102 and a pivot shaft 103 wherein double faced target 101 is affixed to one end 108 of stub shaft 102 and opposite end 109 of stub shaft 102 is affixed to pivot shaft 103. Substantially vertical post 30 is separable from substantially horizontal base 20 and target assembly 100 is separable from substantially vertical post 30. Thus, target system 10 is portable by separating vertical post 30 from base 20 and, if desired, by removing target assembly 100 from vertical post 30. Specifically, target assembly 100 comprises a seven inch round double faced target 101, a stub shaft 102 and a pivot shaft 103, double faced target 101 disposed at a target end 108 of stub shaft 102 and pivot shaft 103 disposed at an opposite pivot end of stub shaft 102. Double faced target may be formed from three-eighths inch thick boiler plate, T-1 armor plate or plow share steel, however, it has been found by the teachings of this invention that the preferred material is three-eighths inch thick wear plate steel having a Brinell hardness number of at least 400. Stub shaft 102 and pivot shaft 103 are formed from cold rolled steel to precisely 1.120 inches in diameter. Length 113 of pivot shaft 103 is approximately fourteen inches such that pivot shaft is fully captured behind inside surface 89 of the capture bracket 45 upon which target assembly 100 is resting and behind inside surface 89 of the capture bracket immediately above, or in the case target assembly 100 is at the uppermost capture bracket 45, pivot shaft 103 is fully captured behind inside surface 77 of both stabilizing brackets 27, 57. Pivot shaft 103 has a pilot shaft hole 111 disposed perpendicular through pivot shaft 103 centrally located along length 113, pilot shaft hole 111 having a chamfer (not shown) on one end for welding pilot shaft 110 of stub shaft 102 thereto. Pivot axis 115 of pivot shaft 103 passes through the longitudinal center of pivot shaft 103 and is adapted to coincide with vertical axis 15 of post assembly 30.

Stub shaft 102 is approximately two and seven-sixteenths inches in length from target end 108 to pivot shaft end 109. Target end 108 of stub shaft 102 has a slot 107 cut transversely therethrough, slot 107 adapted to receive target 101 therein. Target 101 is press fit into slot 107 and welded therein. Pivot shaft end 109 is a reduced diameter of stub shaft 102 and comprises pilot shaft 110, pilot shaft 110 adapted to be press fit into pilot shaft hole 111 in pivot shaft 103 and welded thereto with the longitudinal axis 114 of stub shaft 102 disposed perpendicular to pivot axis 115 and slot 107 in target end 108 aligned with pivot axis 115. Stub shaft 102 is approximately one and one quarter inch long between the juncture with pivot shaft 103 and the juncture with target 101 such that stub shaft 102 does not interfere with any portion of capture bracket 45 when target assembly 100 pivots about axis 115. All weldments are sufficiently small and ground smooth to prevent interference with any portion of capture bracket 45. Although square, hexagonal, octagonal, triangular or other shape stock may be used for stub shaft 102, it has been found by the teachings of this invention that the line contact between the round stock used for stub shaft 102 and the riding and capture surfaces 41, 51, 52, 61 and 67 provides for substantially error free operation of shooting target system 10.

Target 101 is cut from wear plate steel by Electric Discharge Machining, precision flame cutting or laser cutting to seven inches in diameter, these preferred methods providing a smooth outer edge 106 for target 101 without further metal working. Smaller or larger targets may be utilized in shooting target system 10 however, a seven inch target is preferable for military and law enforcement personnel training. When double faced target 101 is assembled to stub shaft 102 and pivot shaft 103, target assembly 100 has a mass of approximately ten pounds thus providing sufficient resistance for use with higher powered fire arms while still allowing target assembly 100 to rotate about axis 115 of pivot shaft 103 when released from capture surface 52.

The preferred embodiment of this invention has been described above, however, alternate constructions to post 30 are also possible. For instance, an alternate round post may be constructed by cutting a slot length wise through a three inch outside diameter round tube wherein the slot would contain a top surface such as top surface 65, capture surfaces such as capture surfaces 52, riding surfaces such as riding surfaces 41, drop angle surfaces such as drop angle surfaces 51, straight edges such as straight edges 55 and bottom surfaces such as bottom surfaces 50, 76 and 87. Each of the riding and capturing surfaces so cut may also be reinforced with hardened steel pads 60 as hereinbefore mentioned, these hardened steel pads 60 being formed to conform to the rounded surface of the round tube used for this alternate post. Pivot shaft 103 may then be constructed from a smooth outside diameter length of steel tubing sized to rotate freely within the inside diameter of the round tube wherein pilot shaft 110 is extended in length to be welded at both ends thereof to the round tubing used for pivot shaft 103.

Similarly, a square box beam may be similarly cut through two of the sides thereof and at least the included corner to make a square post having one of the angular corners thereof arranged to face the shooter addressing such a square beam target post 30. As with the preferred post 30 of this invention, such a square box beam post may similarly be reinforced with hardened steel pads similar to hardened steel pads 60 made to conform to the square box beam. A round tube sized to rotate freely within the internal confines of the box beam may then be used for pivot shaft 103, this pivot shaft 103 constructed in a manner similar to that of the pivot shaft used for a round post. Both the alternate round and box beam posts 30 need not have anti-spray shield affixed there to as fired slugs will be deflected from the exterior surfaces of these posts.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A shooting target system comprising a substantially vertical post supported on a substantially horizontal base, said vertical post having a target assembly rotatably mounted thereupon, said vertical post further having means to releasably capture said target assembly at each one of a plurality of target shooting positions spaced vertically upon said post wherein said target assembly pivots from one side of said vertical post to another side of said vertical post when said target is struck with a slug discharged from a firearm, said shooting target system comprising only one movable part, said one movable part comprising said target assembly wherein said one movable part is captured at said each one of said plurality of target shooting positions by said means to releasably capture as said one movable part traverses vertically downward by force of gravity each time said target assembly is properly struck by a slug from a high powered firearm and thus moved from said one side of said vertical post to said another side of said vertical post.

2. A shooting target system comprising a substantially vertical post having at least one double faced target rotatably mounted thereupon, said vertical post further having means to capture said target at one of a plurality of positions spaced vertically upon said post wherein said shooting target system comprises only one movable part, said one movable part comprising said target assembly wherein said one movable part is captured at said each one of said plurality of positions by a means to releasably capture as said one movable part traverses vertically downward by force of gravity each time said target is properly struck by a slug from a high powered firearm and thus moved from one side of said vertical post to another side of said vertical post.

3. A shooting target system comprising a substantially vertical post, a substantially horizontal base and a rotatable, translatable double side target assembly, said substantially vertical post comprising an I-beam, a bottom member and an anti spray shield said I-beam having a plurality of capture brackets affixed to one face thereof and said anti spray shield affixed to a face opposite said one face, said bottom member affixed to one end of said I-beam, said bottom member having attaching holes disposed therethrough, said horizontal base comprising at least two leg portions separated by a central cross piece wherein said central cross piece having attaching holes disposed therethrough to align with said attaching holes in said bottom member, said cross piece affixed to said leg portions substantially in the center of each leg portion thereof said target assembly comprising a double faced circular target, a stub shaft and a pivot shaft, said double faced target affixed to one end of said stub shaft and the opposite end of said stub shaft affixed to said pivot shaft, said substantially vertical post separable from said substantially horizontal base and said target assembly separable from said substantially vertical post.

* * * * *